US006000301A

United States Patent [19]

Hillinger

[11] Patent Number: 6,000,301

[45] Date of Patent: Dec. 14, 1999

[54] ADJUSTABLE WRENCH

[75] Inventor: George Hillinger, Beverly Hills, Calif.

[73] Assignee: Alltrade Inc., Long Beach, Calif.

[21] Appl. No.: 09/099,851

[22] Filed: Jun. 19, 1998

[51] Int. Cl.[6] ..... B25B 13/16

[52] U.S. Cl. ..... 81/166; 81/167; 81/175

[58] Field of Search ..... 81/155, 157, 164–170, 81/175

[56] References Cited

U.S. PATENT DOCUMENTS

| | | | |
|---|---|---|---|
| 2,001,789 | 5/1935 | Leaveck | 81/166 |
| 4,967,613 | 11/1990 | Cone | 81/166 |
| 5,860,336 | 1/1999 | Chen | 81/170 |

*Primary Examiner*—D. S. Meislin
*Attorney, Agent, or Firm*—Robert R. Thornton

[57] ABSTRACT

An adjustable wrench utilizes a drive member housed in a wrench body. The drive member has a cylindrical drive element having external male threads formed thereon, onto which a guide block is mounted by means of a bore, within which female threads, complementary to the male threads, are formed extending longitudinally through the guide block, so that the drive element extends through the bore with the male and female threads in engagement with one another, whereby rotation of the drive element is operable to move the guide block longitudinally along the drive element. A drive knob is fixed to and manually operable for selectively rotating the drive element. A pair of alignment arms connect a movable jaw element to the guide block so that the movable jaw element faces and is displaced from the drive block in longitudinal alignment with the bore and is separated from the drive knob by the drive block. The drive knob is rotated to move the movable jaw toward and away from a fixed jaw element formed on the wrench body so as to be in longitudinal alignment with the movable jaw element and fixed in position in the wrench housing between the movable jaw and the guide block.

14 Claims, 4 Drawing Sheets

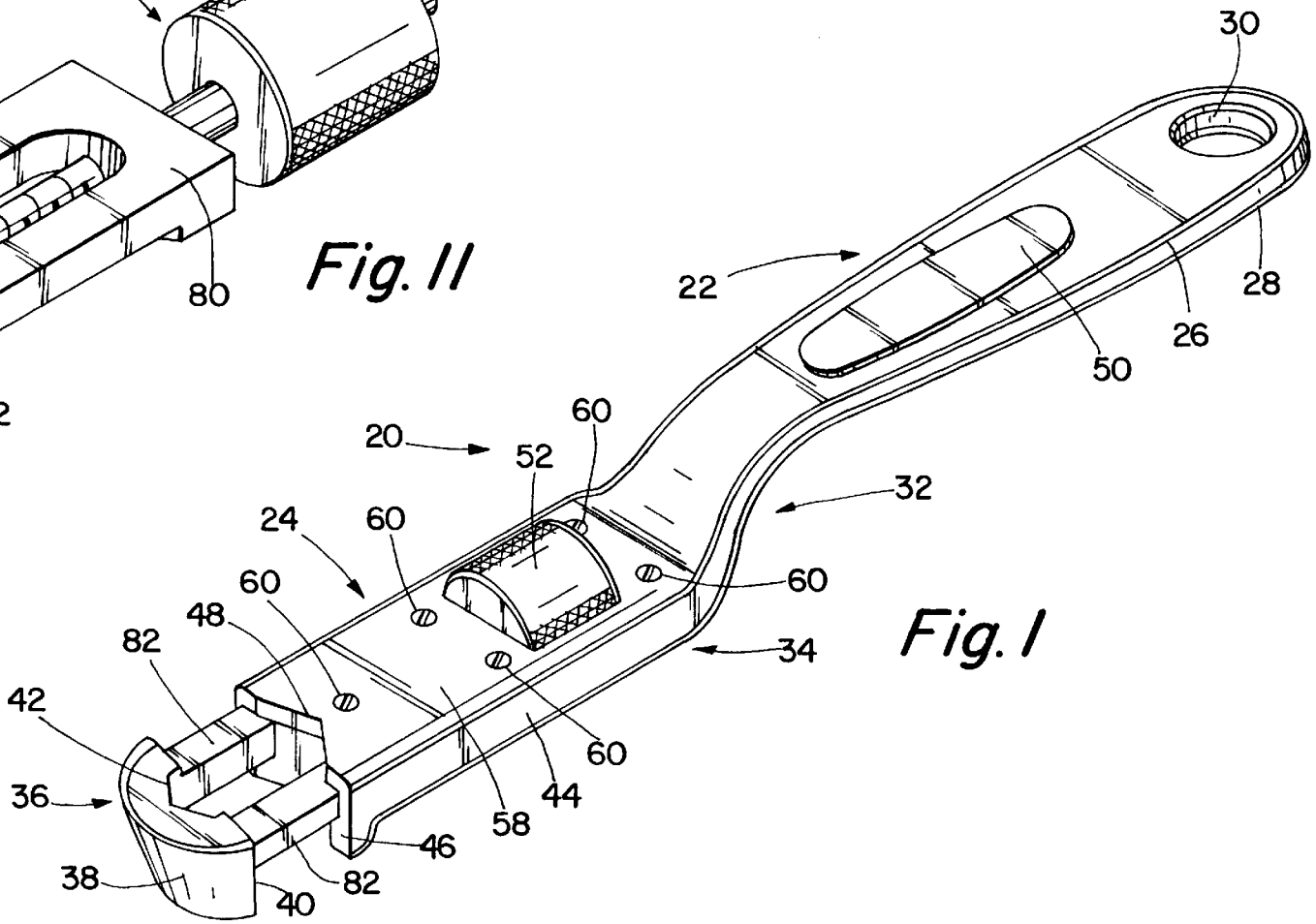
Fig. I
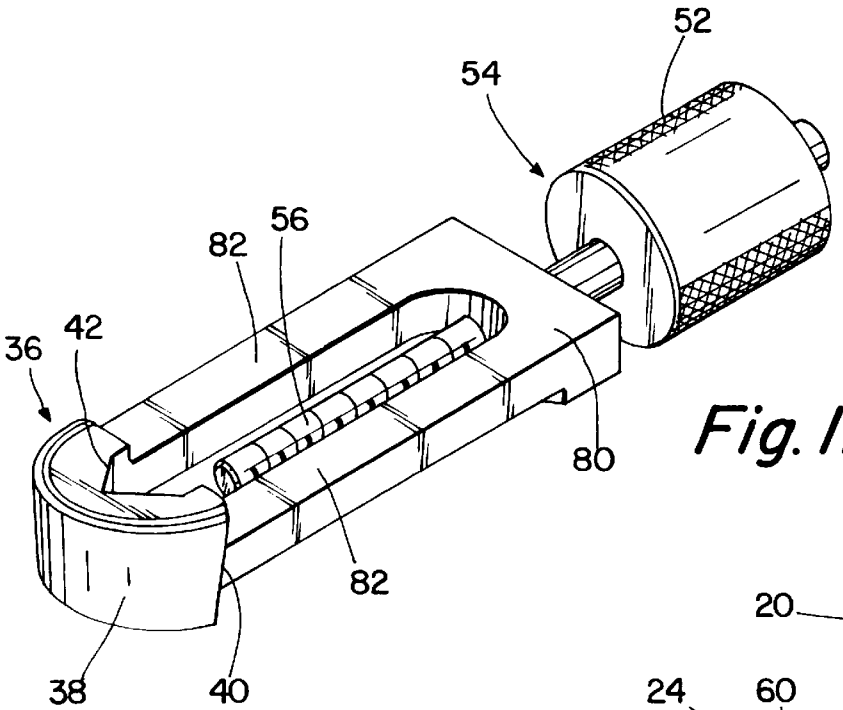
Fig. II

ADJUSTABLE WRENCH

BACKGROUND OF THE INVENTION

The present invention relates to an adjustable wrench which is adapted to engage a variety of non-circular fasteners, and in particular hex nuts and hex bolt heads.

Adjustable wrenches of the general type with which the present invention is concerned are well known. Examples of such adjustable wrenches are shown, for example, in U.S. Pat. No. 2,912,891, issued Nov. 17, 1959, to T. Neff, U.S. Pat. No. 3,204,497, issued Sep. 7, 1965, to L. R. Dinkler, U.S. Pat. No. 4,520,699, issued Jun. 4, 1985, to M. Jeremic, U.S. Pat. No. 4,967,613, issued Nov. 6, 1990 to R. E. Cone, and U.S. Pat. No. 5,415,064, issued May 16, 1995 to C-H. Chang.

The standard arrangement for such adjustable wrenches is to have two jaws, one fixed with respect to the wrench handle and the other movable with respect to the fixed jaw. Typically, as is illustrated in the aforesaid patents, the movable jaw has an actuator element onto which an external male thread is formed, the movable jaw being attached to the actuator element by any one of a variety of means. The handle includes a knurled knob which has a complementary female threaded aperture extending therethrough, through which the male threaded actuator element extends so as to engage the female threads. Manual rotation of the knob, as by a user's thumb, causes the rotary motion of the knob to be translated into linear motion of the movable jaw, so as to selectively either tighten the jaws onto the element to which torque is to be applied or to loosen the jaws therefrom.

Among the principal objectives of the prior art adjustable wrenches, including those configurations shown in the aforementioned patents, are to produce an adjustable wrench which is strong, easy to use, can be used in close quarters, and fully grips the object to which torque is to be applied by at least half of its torquing surfaces. While all of these wrenches have been successful in achieving some or all of these objectives to a greater or lesser degree, they all suffer from a deficiency inherent in the utilization of the male-female thread relationship referred to above, in which the male thread is externally formed on the element which must pass through the interior of the knurled knob which is rotated in order to make the jaw adjustments. Because of the tolerances required in the assembly line manufacture of such adjustable wrenches, the "play" between these two element is sufficient to carry over into the gripping of the fastener to permit some "play" in the handle in use when the jaws grip the hex nut or bolt or other object to which torque is to be applied.

Even U.S. Pat. No. 4,967,613, referred to above, is not entirely successful in solving this problem, even though the adjustable wrench of this patent utilizes dovetail supports for alignment purposes for the moving elements, an obviously expensive structure. The use of dovetail supports would appear to be a satisfactory solution to this problem. However, because of the comparatively short length of the dovetail surfaces in contact at any one time in the design illustrated in Pat. No. 4,967,613, and the tolerances necessarily involved in the mass production of such a device, the device has not entirely solved the problem of "play" referred to above.

Consequently, a need still exists for an improved adjustable wrench which will be strong, easy to use, can be used in close quarters, and can fully grip the object to which torque is to be applied on at least half of its torquing surfaces without excessive play while avoiding the design deficiencies inherent in the prior art structure of a movable jaw with an actuator element onto which an external male thread is formed as the driven element, a handle having a knurled knob with a complementary female threaded aperture extending therethrough as the drive element, through which the male threaded actuator element extends so as to engage the female threads.

BRIEF SUMMARY OF THE INVENTION

According to the present invention, an adjustable wrench has a fixed jaw member and a movable jaw member, the fixed jaw member having a generally hollow central portion terminating in a first end to which a handle is joined and in a second end in a fixed jaw element, the movable jaw member having a movable jaw element formed at a one end and a guide block formed at its opposite end, the guide block means being disposed in the hollow central portion so that the movable jaw element is disposed if externally of the fixed jaw member and in longitudinal alignment therewith, and includes means for limiting the movement of the guide block within the hollow central portion to linear longitudinal motion, and means for selectively manually initiating longitudinal relative movement between the first jaw element and the second jaw element which includes a threaded drive member with male threads formed externally there along with means for fixing the drive member within the hollow central portion so that the drive member is laterally and longitudinally fixed in position there within and is selectively manually rotatable with respect thereto, the guide block having a complementary female thread extending longitudinally therethrough the guide block for rotatably engaging the male threads of the drive member, whereby selective manual rotation of the drive member initiates longitudinal linear relative motion between the two jaw elements.

BRIEF DESCRIPTION OF THE SEVERAL VIEWS OF THE DRAWING

The invention may be more readily understood by reference to the accompanying drawing, in which:

FIG. 1 is a view, in perspective, of an adjustable wrench according to the present invention;

FIG. 11 is a view, in perspective, of the preferred embodiment of the drive element of the adjustable wrench of FIG. 1.

DETAILED DESCRIPTION OF THE INVENTION

Figure 2:
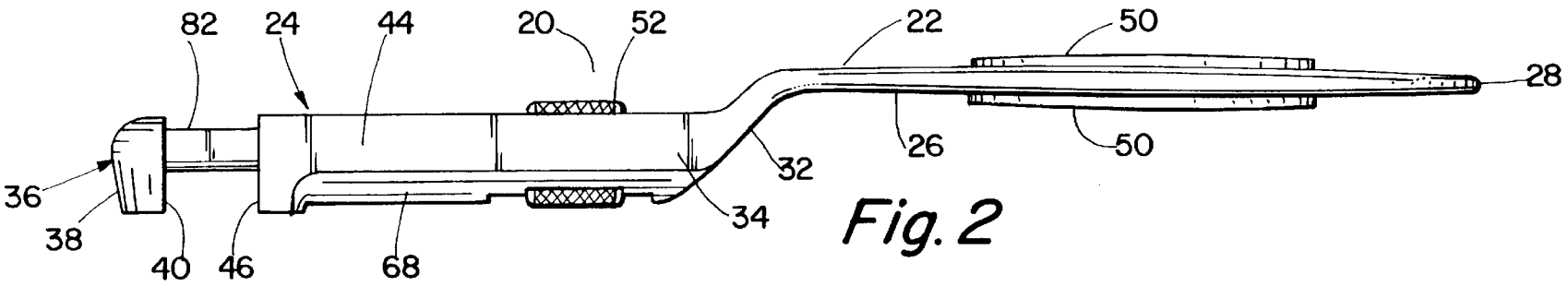
FIG. 2 is a right side elevational view of the wrench of FIG. 1.

Referring now to FIG. 1, there is shown in perspective an adjustable wrench 20 according to the present invention. The wrench 20 has a handle portion 22 and a fastener engaging portion 24. The handle portion 22 includes a handle 26 terminating at a first end 28 in an aperture 30, which may be used to hang the wrench 20 from a peg or the like when not in use. The handle 26 has a downwardly depending second end 32, which joins the fastener engaging portion 24 at a first end 34 thereof. The fastener engaging portion 24 has a second end 36, at the outer extremity of which a movable jaw member 38 is disposed. The movable jaw member 38 has an inner face 40, on which a movable jaw element 42 is formed. The fastener engaging portion 24 has a main body element 44, which terminates at one end in the first end 34, and at its opposite end in an outer face 46, which is disposed opposite the movable jaw member inner face 40 and in which a fixed jaw element 48 is formed so as to be in longitudinal alignment with the movable jaw element 42. As shown in FIG. 1, the jaw elements 42,48 are adapted to receive hexagonal torquing elements for fasteners. However, it will be obvious that the jaw elements 42,48 are configurable in whatever surfaces are appropriate to apply torque to the particular fastener system being utilized.

Referring now to FIG. 2, a side elevational view of the wrench 20 is shown. The handle 26 has a pair of raised extended ovals 50, one each on the upper and lower faces of the handle 26, on which the manufacturer's identification, trademarks and the like can be carried. A actuator knob 52, shown by way of example as being knurled, is adapted to be rotated by a user's thumb when the wrench handle 26 is held in the user's hand. As is seen in FIG. 2, the knob 52 is disposed in the main body element 44 so as to extend vertically beyond both the upper and lower surfaces thereof, thereby permitting the wrench to be used in either the relative position shown in the various figures, or inverted therefrom, depending upon the particular circumstances of use, as is discussed in U.S. Pat. No. 4,967,613.

The actuator knob 52 is a component of a drive member 54, shown in perspective in FIG. 11. In addition to the knob 52, the drive member 54 includes a threaded drive element 56, having male threads formed externally thereon, and to which the knob 52 is fixed, so that rotation of the knob 52 rotates the threaded drive element 56 in the same direction of rotation, thereby actuating the adjustability feature of the wrench 20, as will be explained hereinafter.

Figure 3:
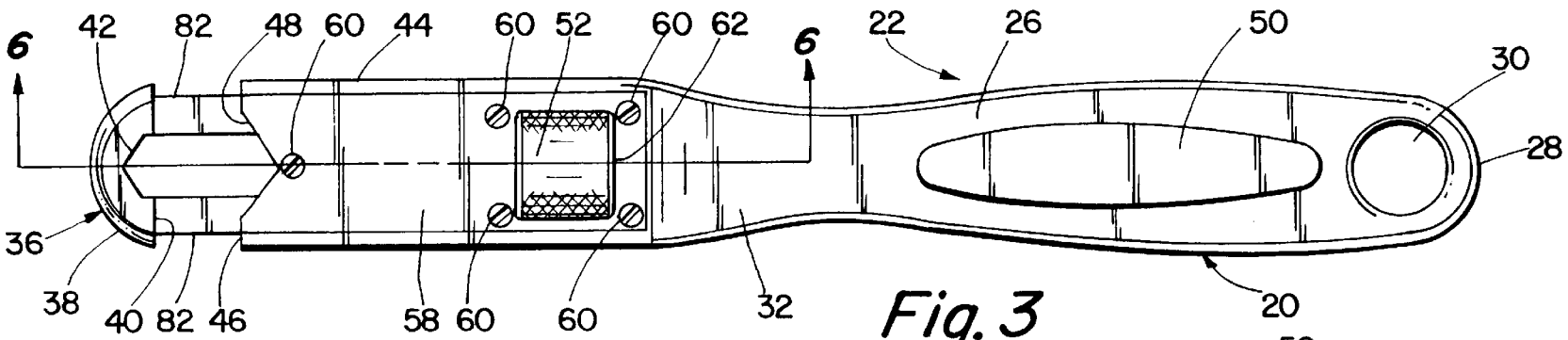
FIG. 3 is a top plan view of the wrench of FIG. 1.

Referring now to FIG. 3, a top plan view of the wrench is shown. In the preferred embodiment, a top cover plate 58 is attached to the main body element 44 by five screws 60, in order to cover the hollow interior of the main body 44 (not shown, see FIG. 5 and FIG. 8). The top cover plate 58 serves to enclose the operating mechanism of the wrench 20 to protect it from dirt and to protect the user from being pinched by it in operation, in addition to serving to limit the "play" in the wrench actuating mechanism, as will be apparent from the subsequent description thereof, particularly with respect to FIG. 7. The cover plate 58 has a generally rectangular aperture 62 formed therein for receiving the knob 52. The size of the aperture 62 is preselected in the preferred embodiment to be complementary to the lateral cross-sectional dimensions of the knob 52 at the top cover plate 62, so as to restrict the lateral and longitudinal, but not the rotational, movement of the knob 52.

Figure 4:
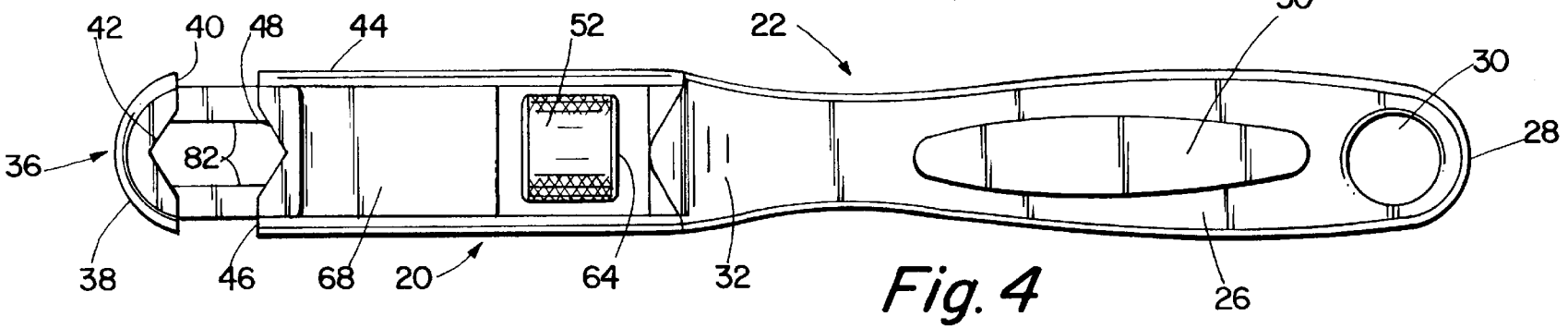
FIG. 4 is a bottom plan view of the wrench of FIG. 1.

Referring now to FIG. 4, there is shown a bottom plan view of the wrench 20. As is seen in FIG. 4, the main body element 44 has an aperture 64 formed therein, through which the knob 52 extends, as the main body element aperture 64 and the top cover plate aperture 62 are in lateral and longitudinal alignment. Again, as with the aperture 62, in the preferred embodiment the size of the aperture 64 is selected to be complementary to the lateral cross section of the knob extending therethrough for the same reasons, although, for purposes of illustration, a clearance, greater than actually exists in the preferred embodiment, is shown for clarity.

Figures 5, 6, 7, 8, 9:
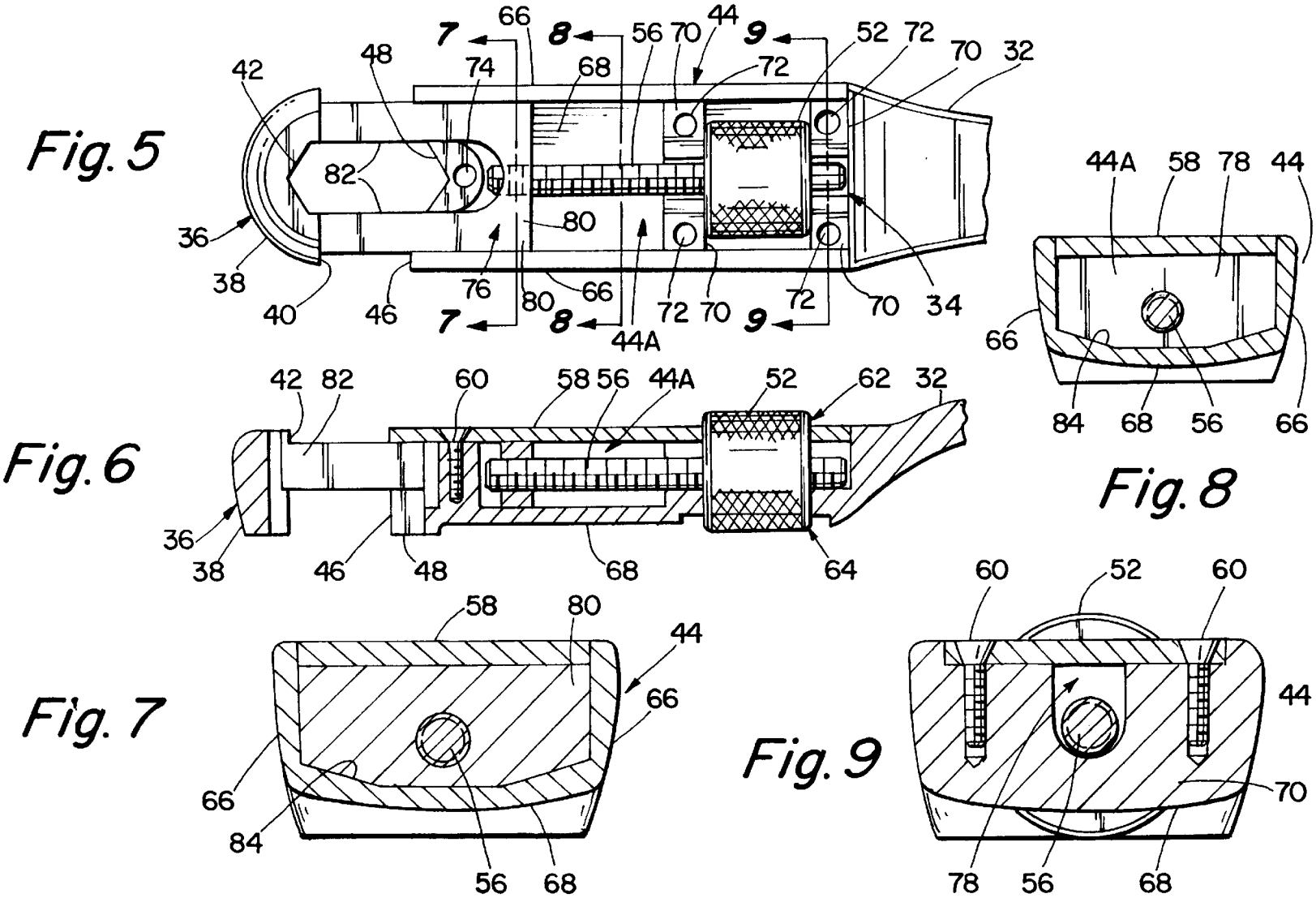
FIG. 5 is a partial top plan view of the wrench as shown in FIG. 3, with its top cover plate removed.
FIG. 6 is a partial right side elevational view, in section, of the wrench as shown in FIG. 2.
FIG. 7 is a view, in section, of the wrench as shown in FIG. 2, taken along lines 7—7 of FIG. 5.
FIG. 8 is a view, in section, of the wrench as shown in FIG. 2, taken along lines 8—8 of FIG. 5.
FIG. 9 is a view, in section, of the wrench as shown in FIG. 2, taken along lines 9—9 of FIG. 5.

Referring now to FIG. 5 and FIG. 6, there are shown partial top plan and side elevational views of the wrench 20 with the top cover plate 58 removed from the main body portion 44 in FIG. 5 and installed in FIG. 6. The main body portion 44 has a generally hollow rectangular interior 44A, which is bounded by the first end 34, the fixed jaw element 48, a pair of side elements 66 and a bottom element 68. The knob 52 is disposed between two mounting yokes 70, each yoke 70 having a pair of threaded recesses 72 for receiving two of the five screws 60 for securing the top cover plate 58 to the main body 44 (see FIG. 3). A fifth threaded recess 74 is formed in the fixed jaw element 48 for receiving the fifth of the five screws 60 to complete the attachment of the top cover plate 58. A bifurcated guide block 76 has a body portion 80 with two bifurcated alignment arms 82 fixing the body portion 80 to the movable jaw inner face 40. The guide block 76 is disposed in the main body hollow interior 44A so as to have the fixed jaw element 48 disposed between the body portion 80 and the movable jaw element 42. The body portion 80 has a passageway extending longitudinally therethrough which is threaded with a female thread complementary to the male thread of the drive element 56. The drive element 56 is threaded onto the body portion 80 so that the drive element 56 extends therethrough and terminates immediately adjacent the fixed jaw element 48. The opposite end of the drive element 56 terminates at the handle second end 32. As noted above, any longitudinal movement of the knob 52, and so the drive member 54, is preferably precluded by the sizes of one or both of the top cover plate aperture 62 and the main body element aperture 64. However, in addition to or as an alternative thereto, the longitudinal movement of the drive member 54 can be limited by the selection of the spacing between the two yokes 70 and/or the selection of the overall length of the threaded drive element 56 so as to be in contact the fixed jaw element 48 at one end of the drive element 56 and with the handle second end 32 at the other end of the drive element 56. The lateral movement of the drive element 54 is also limited by the yokes 70, each of which provides a longitudinally aligned recess for receiving the threaded drive element 56.

Referring now to FIG. 7, there is shown a view in section of the wrench as shown in FIG. 2, the section being taken along a line as shown as 7—7 in FIG. 5. As is shown in FIG. 7, the guide block body portion 80 effectively fills the main body hollow interior 44A both laterally and vertically, so that the top cover plate 58, together with the sides 66 and bottom 68 of the main body portion 44, prevent the movement of the guide block body portion 80 other than longitudinally toward and away from the fixed jaw element 48. The alignment arms 82, to which the movable jaw 42 is fixed, complete a "box" structural element for the movable jaw member 38 to provide maximum structural rigidity with a minimum of structural material. The alignment arms 82, by the length of their contact with the sides 66, function to further reduce any "play" resulting from variations in manufacturing tolerances. In addition, in the preferred embodiment, the bottom 68 has an interior surface which is not planar, the particular example shown in FIG. 7 having three separate angles in the inner surface. The guide block main body portion 76 has a lower surface 84 which is complementary to the inner surface of the bottom, thereby providing two additional surfaces to maintain longitudinal alignment of the guide block a during longitudinal movement so as to further reduce any "play" which might otherwise result during the torquing of a fastener.

Referring now to FIG. 8, there is shown a view, in section, of the wrench 20 as shown in FIG. 2, taken along lines 8—8 of FIG. 5. As is seen in FIG. 8, the hollow inner portion 44A is completely enclosed by the sides 66, bottom 68, and top cover plate 58.

Referring now to FIG. 9, there is shown a view, in section, of the wrench 20 as shown in FIG. 2, taken along lines 9—9 of FIG. 5. As is seen in FIG. 9, the drive element 56 is positioned in a U-shaped recess 78 formed in the yoke 70 so as to extend transversely therethrough.

Figure 10:
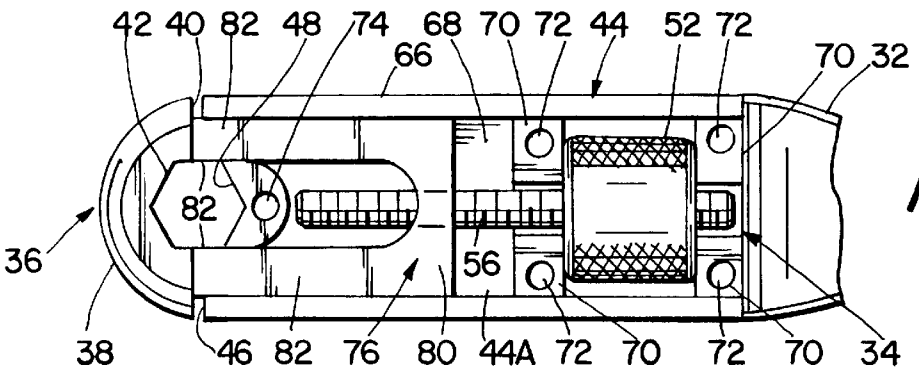
FIG. 10 is a top plan view of the wrench as shown in FIG. 5, but with the jaw elements closed on one another with respect to their disposition shown in FIG. 5.

Referring now to FIG. 10, there is shown a view, in section, of the wrench 20 as shown in FIG. 5, but with the drive element 56 having been rotated by the user rotating the knob 52, so as to move the guide block 76 toward the yokes 70, and so cause the movable jaw element 42 to close on the fixed jaw element 48, while the knob 52 and the drive element 56, because they are fixed to one another, and preferably of a unitary construction, remain fixed in longitudinal and rotary position with respect to one another, as distinguished from the longitudinal and rotary relative movement between similar parts, such as between the adjusting thumbwheel and adjusting screw of U.S. Pat. No. 4,967,613 or their equivalents in the other prior art patents referred to above, required for the closing and the opening of the jaw elements in those patents.

Figure 12:
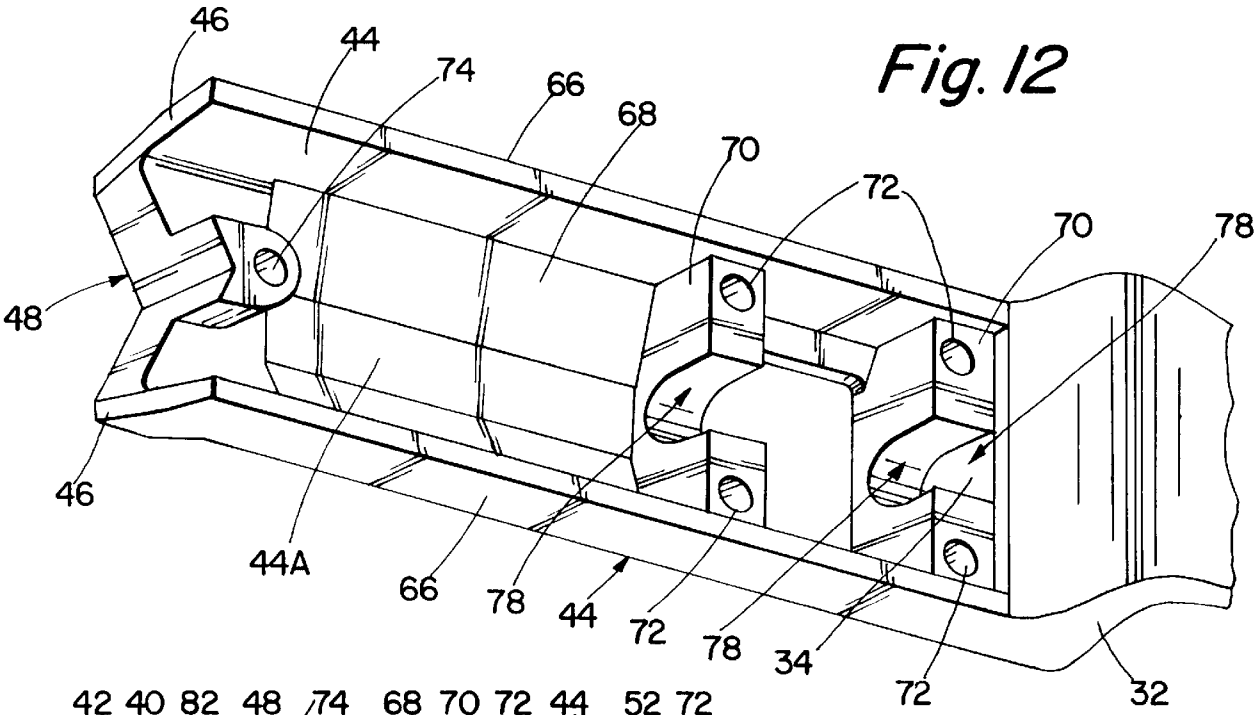
FIG. 12 is a partial plan view, in perspective, of the body portion of the wrench of FIG. 1 with its top plate cover removed as in FIG. 5.

Referring now to FIGS. 11 and 12, there are shown in perspective the movable jaw member 38 and the main body 44. In the preferred embodiment of the invention, the movable jaw member 38 is assembled as shown in FIG. 11, that is, the externally threaded drive element 56 is threaded into the complementary female threads extending through the guide block 76 so as to attach the movable jaw element 42 to the guide block 76. The knob 52 is fixed to the threaded drive element 56 against rotary or longitudinal relative movement by any conventional means, and, if desired, can be manufactured as a single piece.

In order to assemble the wrench 20, the movable jaw member 38 is placed in the open hollow central portion 44A of the main body 44 so that the knob 52 lies between the yokes 70, with the drive element 56 lying in the U-shaped recesses 78 formed centrally in the yokes 70. The top cover plate 58 then placed on the main body 44 so as to cover the hollow central portion 44A, the knob 52 passing through the aperture 62 in the top cover plate 58 and the aperture 64 in the bottom element 68. The top cover plate 58 is then fixed to the main body 44 by any conventional means, such as the screws 60, and the wrench 20 is fully assembled and ready for use. The use of the top cover plate 58, together with the movable jaw member 38 shown in FIG. 11, not only provides for a greatly simplified and expedited assembly process, even with respect to that described in U.S. Pat. No. 4,967,613, but also provides for a wrench which can be easily disassembled for cleaning or the rapid and inexpensive replacement of the drive element 56 or parts thereof with respect to the typical prior art adjustable wrench of this type.

The novel adjustable wrench 20, as described above in its presently preferred embodiment, provides an adjustable wrench which is strong, easy to use, easily repaired, can be used in close quarters, can be inverted for use in order to grip the fastener element from either side of the wrench, and fully grips the fastener element to which torque is to be applied by at least half of the fastener element torquing surfaces.

Although the presently preferred embodiment of the invention have been set forth herein in detail for illustrative purposes, it will be apparent to those skilled in the art that variations and modifications thereof, lie within the scope of the present invention, which is not limited to the specific structures of the embodiments shown or described herein, but only by the scope of the following claims.

The invention claimed is:

1. A drive member for use in an adjustable wrench comprising:

a cylindrical drive element having male threads formed on at least a portion of the external surface thereof, a guide block having a bore extending longitudinally therethrough with female threads, complementary to said male threads, formed in said bore, the guide block being mounted on the drive element so that the drive element extends through the bore with the male and female threads in engagement with one another, whereby rotation of the drive element is operable to move the guide block longitudinally along the drive element, drive means fixed to the drive element and manually operable for selectively rotating the drive element, a jaw element, and a pair of alignment arms connecting the jaw element to the guide block so that the jaw element faces and is displaced from the guide block in longitudinal alignment with the bore and is separated from the drive means by the guide block.

2. An adjustable wrench having a handle;

jaw means having a fixed member and a movable member;

means joining the jaw means fixed member to one end of the handle, the jaw means fixed member having a generally hollow central portion, the jaw means fixed member terminating in a first end to which the handle is joined, and in a second end in a first jaw element, the jaw means movable member having a second jaw element formed at a first end thereof, and guide block means formed at a second end thereof opposite the first end, the guide block means being disposed in the hollow central portion so that the second jaw element is disposed externally of the jaw means fixed member and in longitudinal alignment with the first jaw element;

means for limiting the movement of the guide block means within the hollow central portion to linear longitudinal motion; and means for selectively manually initiating longitudinal relative movement between the first jaw element and the second jaw element comprising a threaded drive member with male threads formed there along, means for fixing the drive member within the hollow central portion so that the drive member is laterally and longitudinally fixed in position there within and is selectively manually rotatable with respect thereto, and complementary female thread means formed on the guide block for rotatably engaging the threads of the threaded drive member, whereby selective manual rotation of the drive member in a first rotary direction moves the guide block along the male threads in a first linear direction so as to move the second jaw element toward the first jaw element, and selective manual rotation of the drive member in the opposite rotary direction moves the guide block along the male threads in the opposite linear direction to move the second jaw element away from the first jaw element.

3. The wrench of claim 2, and the guide block means includes a pair of alignment arms which connect to guide block means to the movable jaw element and are disposed within the hollow central portion of the jaw means fixed member so as to be in longitudinal slidable engagement with the jaw means fixed member.

4. The wrench of either claim 2 or claim 3, and in said which jaw means hollow central portion has a normally open top, and in which the means for limiting the movement of the guide block means within the hollow central portion to linear longitudinal motion includes a top cover plate attached to the jaw means fixed member so as to cover the open top, said top cover plate having an aperture formed therein for receiving a cylindrical drive knob which is attached to the threaded drive member.

5. The wrench of either claim 2 or claim 3, and in which the means for limiting the movement of the guide block means within the hollow central portion to linear longitudinal motion includes a pair of mounting yokes fixed to the jaw means fixed member in the hollow central portion in longitudinal alignment with one another and adapted to receive the threaded drive element so that a cylindrical drive knob which is attached to the threaded drive member is disposed therebetween.

6. The wrench of either claim 2 or claim 3, and in which the threaded drive member is a cylindrical element having a first end adjacent one end of the hollow central portion and a second end adjacent the other end of the hollow central portion, and in which the means for limiting the movement of the guide block means within the hollow central portion to linear longitudinal motion includes the engagement of the threaded drive member ends with the aforesaid ends of the hollow central portion.

7. The wrench of claim 2 or claim 3, and in which the means for limiting the movement of the guide block means within the hollow central portion to linear longitudinal motion includes a pair of alignment arms which connect the guide block means to the movable jaw element and are disposed in the jaw means fixed member hollow central portion so as to be in longitudinal slidable engagement therewith.

8. An adjustable wrench having a handle having a longitudinal axis, jaw means having a fixed portion and a movable portion, means joining the jaw means fixed portion to the handle at a first handle end, said first handle end depending downwardly from the handle and the jaw means fixed portion extending outwardly away from the handle generally parallel to the handle longitudinal axis, the jaw means fixed portion having a generally hollow central portion which is bounded by a first side, a second side, a bottom, a top, a first end, and a second end, which are normally closed, the jaw means fixed portion terminating at a first end in a closed face to which the first handle end is joined and at a second end in a first jaw element disposed intermediate the first and second sides, the jaw means movable portion having a second jaw element formed at a first end thereof and a guide block formed at a second end thereof opposite the first end, said guide block being of a width which is generally complementary to the width of the jaw means fixed portion hollow central portion between the first and second sides so that the guide block is slidable longitudinally there along from a disposition adjacent the first jaw element to a disposition remote therefrom, said second jaw element and said guide block being fixed to one another by a pair of parallel longitudinal alignment arms extending therebetween, the guide block and alignment arms being disposed in the jaw means fixed portion hollow central portion so that the alignment arms engage the sides and the guide block engages the bottom and top of the hollow central portion, with the second jaw element disposed externally of the jaw means fixed portion and in longitudinal alignment with the first jaw element, and means for selectively manually initiating longitudinal relative movement between the first jaw element and the second jaw element comprising a threaded cylindrical drive member, means for fixing the cylindrical drive member within the jaw means fixed portion hollow central portion so that the cylindrical drive member is laterally and longitudinally centrally fixed in position there within and is selectively manually rotatable with respect thereto, and means for threadably engaging the guide block onto the cylindrical drive member, whereby selective rotation of the drive member in one direction causes the relative movement of the second jaw element toward the first jaw element and selective rotation of the drive member in the opposite direction causes relative movement of the second jaw element away from the first jaw element.

9. The wrench of claim 8, and in which the means for threadably mounting the guide block onto the drive member includes male threads formed on at least a portion of the cylindrical drive member, and an aperture extending longitudinally through the guide block, within which female threads are formed which are complementary to the male threads on the cylindrical drive member.

10. The wrench of either claim 8 or claim 9, and in which the normally closed top of the hollow central portion is normally closed by a top cover plate which is selectively detachable therefrom.

11. The wrench of either claim 8 or claim 9, and in which the means for fixing the drive member within the hollow central portion includes an aperture formed in the normally closed top for receiving a cylindrical drive knob which is attached to the cylindrical drive member.

12. The wrench of either claim 8 or claim 9, and in which the means for fixing the drive member within the hollow central portion includes a pair of mounting yokes fixed to the jaw means fixed member in the hollow central portion in longitudinal alignment with one another and adapted to receive the cylindrical drive member so that a cylindrical drive knob which is attached to the threaded drive member is disposed therebetween.

13. The wrench of either claim 8 or claim 9, and in which the threaded cylindrical drive member includes a cylindrical element having a first end adjacent the first end of the hollow central portion and a second end adjacent the second end of the hollow central portion, and in which the means for fixing the drive member within the hollow central portion includes the limitation of the longitudinal movement of the cylindrical element by contact with at least one of the ends of the hollow central portion.

14. The wrench of either claim 8 or claim 9, and in which the means for limiting the movement of the guide block within the hollow central portion to linear longitudinal motion includes the pair of alignment arms.

* * * * *